United States Patent [19]

Yasuda et al.

[11] Patent Number: 5,009,352

[45] Date of Patent: Apr. 23, 1991

[54] APPARATUS FOR CONVEYING DIELECTRIC SHEETS

[75] Inventors: Masashi Yasuda, Kobe; Yoshihiro Uchimoto, Habikino; Yasunori Mikata, Hyogo, all of Japan

[73] Assignees: Bando Chemical Industries, Ltd., Hyogo; Unico Co., Ltd., Osaka, both of Japan

[21] Appl. No.: 374,541

[22] Filed: Jun. 30, 1989

[30] Foreign Application Priority Data

Jul. 1, 1988 [JP] Japan ..... 63-165740

[51] Int. Cl.[5] ..... B65H 20/00; G03G 15/02

[52] U.S. Cl. ..... 226/94; 355/226; 355/303; 355/305

[58] Field of Search ..... 226/94, 170, 93; 355/221, 222, 223, 224, 225, 226, 303, 305, 302; 361/234

[56] References Cited

U.S. PATENT DOCUMENTS

| | | | |
|---|---|---|---|
| 3,254,215 | 5/1966 | Oliphant | 355/224 X |
| 3,325,709 | 6/1967 | Anderson | 226/94 X |
| 4,408,864 | 10/1983 | Hardenbrook | 355/221 |
| 4,448,511 | 5/1984 | Masuda | 355/221 |
| 4,555,171 | 11/1985 | Clouthier et al. | 355/224 |
| 4,676,627 | 6/1987 | Ohno | 355/221 |
| 4,766,515 | 8/1988 | Bollen et al. | 361/234 |
| 4,853,736 | 8/1989 | Goto et al. | 355/221 X |

*Primary Examiner*—Daniel P. Stodola
*Assistant Examiner*—Paul Thomas Bowen
*Attorney, Agent, or Firm*—Koda and Androlia

[57] ABSTRACT

In an apparatus for conveying dielectric sheets used in copying machines, etc., sheets are held by electrostatic adhesion on the surface of a conveyor when such surface is electrically charged and thus conveyed by the conveyor, wherein a dielectric layer consisting of a dielectric material and electrode parts consisting of a conductive material, which are electrically connected to portions of the dielectric layer and grounded, are provided adjacent to each other on an adhesion surface of the conveyor.

7 Claims, 6 Drawing Sheets

APPARATUS FOR CONVEYING DIELECTRIC SHEETS

BACKGROUND OF THE INVENTION

1. Field of the Invention

The present invention relates to a paper conveying mechanism used in copying machines, printers, etc.

2. Prior Art

As shown in FIG. 9, conventional conveyor mechanisms used in copying machines, etc. basically consist of a conveyor belt 62, which is provided with holes H and driven by a driving roller 61, and a suction fan 63 which is installed beneath the conveyor belt 62. By operating the suction fan 63, an air current C is created which flows from the upper surface A to the conveyor belt 62 toward the lower surface B of the belt 62 via the holes H formed in the belt 62.

When the paper P is fed onto the conveyor belt 62, the holes H on the conveyor belt 62 are blocked by the presence of the paper P and the air current C is thus also blocked. Accordingly, a slight pressure difference is created between the upper surface A and lower surface B. As a result, the paper P is caused to adhere to the conveyor belt 62 by the pressure difference. Then, when the conveyor belt 62 moves, the paper P moves along with the belt.

However, the conveyor mechanism constructed as described above has the following problems. Since the mechanism requires a conveyor belt, suction fan and exhaust duct 64, a large space is required for the installation of these parts. As a result, an apparatus which uses these parts is increased in size. Furthermore, since the parts involve additional expense, the apparatus tends to be more costly.

Furthermore, since the suction-adhesion force which determines the paper conveying capacity of the apparatus depends on the capacity (or strength) of the suction fan, it is necessary to use a large suction fan in order to increase the paper conveying capacity of the apparatus, and this creates problems in terms of further increases in the size and cost of the apparatus.

Moreover, in cases where such a conveyor mechanism is used in electronic photographic devices such as copying machines and printers which use toner, the toner is blown about inside of the apparatus by the turbulence created by the suction fan. This causes problems of toner contamination in the surrounding areas. In addition, the operating noises generated by the suction fan is deleterious on the quiet atmosphere preferred for the office environment.

In the prior art there is also known a transfer belt system which solves the above-described problems. As shown in FIG. 10, this system is equipped with a transfer belt 72 which is used in both the transfer process and the conveying process, a photo-sensitive part 71, a main charger 73, a developing roller 74, and a belt charger 75.

The transfer belt 72 consists of two layers: a dielectric layer on the outer surface side and a conductive layer on the underside. An electric charge is imparted to the outer surface of the transfer belt 72 by the belt charger 75. Paper P is fed onto the transfer belt 72 by conveying rollers 76 and is conveyed to the transfer area D by the transfer belt 72.

When the photosensitive part 71 is irradiated with image exposing light after being, for example, positively charged by the main charger 73, a latent image consisting of a positive electric charge is formed on the surface of the photosensitive part 71. When toner which has been negatively charged is supplied via the developing roller 74, the toner T electrostatically adheres to the latent image area, so that a positive image formed by the toner is developed.

Next, in the transfer area D, an electric field E is formed (see FIG. 11) between the photosensitive part 71 and the transfer belt 72 by the positive charge p on the surface of the transfer belt 72. Accordingly, since the paper P is a dielectric material, when the paper P is conveyed into the electric field E, a negative charge n' is created on the side of the paper P that faces the transfer belt 72 and a positive charge p' is created on the side of the paper P that faces the photosensitive part. Accordingly, the toner which forms a positive image on the surface of the photosensitive part 71 and is negatively charged, is attracted by the positive charge p' on the side of the paper P that faces the photosensitive part 71. As a result, a positive image is transferred to the surface of the paper P.

The paper P onto which the positive image has been transferred is then separated from the surface of the photosensitive part 71, and while still adhered to the transfer belt 72 conveyed into the fixing area (not shown) through the conveying area F.

In the conveying area F (see FIG. 10), the paper P is conveyed while it is still firmly fixed to the transfer belt 72 by the residual negative charge n' on the surface of the paper P and the positive charge p on the transfer belt 72. However, the above described transfer belt system also has inherent problems, i.e. the transfer belt 72 tends to be soiled by the toner.

The reason for this is that the transfer belt 72 which comes into direct contact with the photosensitive part 71 is extremely susceptible to being soiled by toner adhering to the surface thereof except for the areas which have been covered by the paper P. Furthermore, since the toner is electrostatically charged, it shows an especially strong tendency toward adhesion. Moreover, such soiling of the transfer belt 72 leads not only to the paper P being soiled, but also to a loss of the required electrostatic adhesion force. This causes paper jams due to the inability of the paper to adhere to the transfer belt 72.

FIG. 12 shows an improved version of a transfer belt system in which the transfer process and the conveying process are separated (hereunder called "separate process system"). The separate process system differs from the transfer belt system in the following respects: (a) a prescribed gap d is formed between the conveyor belt 92 and the photosensitive part 91 so that the toner on the photosensitive part 91 is not attracted by the charge on the conveyor belt 92 and (b) the system is designed so that transfer (or copying) is accomplished by means of a conventional transfer charger, transfer roller or pressure transfer process.

In such a separate-process system, the conveyor belt 92 is not soiled by toner; thus, even without any special cleaning means being provided for the surface of the belt, the paper is not soiled.

Experiments were performed to ascertain the main factors involved in the electrostatic adhesion force between the conveyor belt 92 and the paper P. It was found that the electrostatic adhesion force is proportional to the charge on the surface of the conveyor 92. However, it was also found that the experimental data representing this adhesion force showed considerable fluctuation according to factors such as the temperature and humidity in which the experiments were performed, the time elapsed after opening the package of the copying paper and the positions of the photosensitive part 91 and the conveyor belt 92. Accordingly, in this system paper cannot be stably conveyed using a minimal charge. As a result, there have been problems in the practical application of this system.

When the causes of the above mentioned variations in the adhesion force in the separate-process system were investigated, the following findings were obtained:

Specifically, since the gap between the photosensitive part 91 and the conveyor belt 92 is large, the electric field is small in inverse proportion to the gap. Accordingly, the quantity of the charge created on the surface of the paper P is extremely sensitive to variations in the dielectric constant of the paper P. As a result, the quantity of the charge created on the surface of the paper P varies with temperature, humidity and the time elapsed following the opening of the copying paper package. Consequently, the force with which the paper adheres to the conveyor belt 92 shows considerable variation.

With the above described conventional apparatuses in mind, there has been a demand for a conveyor mechanism which would not soil the paper with toner and in which stable conveying can be accomplished using a minimal electric charge.

SUMMARY OF THE INVENTION

In view of the above problems in the prior art, the present invention provides a separate-process paper conveying system in which the quantity of the charge created on the paper is sufficiently increased. Specifically, the apparatus of the present invention is characterized by the fact that the sheets that are to be conveyed and made of a dielectric material are held by electrostatic adhesion on the adhesion surface of a conveying means as a result of the adhesion surface charged by a charging means. The sheets are conveyed by causing the conveying means to move, wherein a dielectric layer consisting of a dielectric material and electrode parts consisting of a conductive material which are connected to portion of the dielectric layer and grounded, are provided adjacent to each other on the adhesion surface of the conveying means.

It is possible to design the above structure so that the dielectric layer is formed on the adhesion surface of the conveying means, and a multiple number of band shaped conductive layers are provided on the upper surface of the dielectric layer. Alternately, the dielectric layer can have a multiple number of openings and the conductive layer is formed on the undersurface of the dielectric layer. Furthermore, the conductive layer consisting of conductive material can be formed on the adhesion surface of the conveying means and a multiple number of band shaped dielectric parts on the upper surface thereof. Alternately, a conductive layer having a multiple number of openings may be provided on the adhesion surface of the conveying means so that the dielectric layer is formed on the undersurface of the conductive layer.

Furthermore, the conveying means may be a flexible belt or a cylindrical drum.

As described above, in the sheet conveying apparatus of the present invention wherein, the sheets of dielectric material are held by electrostatic adhesion on the adhesion surface of a conveying means and conveyed by such a conveying means, a dielectric layer consisting of a dielectric material and electrodes parts consisting of a conductive material connected to portions of the dielectric layer and grounded are installed adjacent to each other on the adhesion surface of the conveying means.

Accordingly, when the adhesion surface of the conveying means is charged by a charging means, a charge from the charging means accumulates on the surface of the dielectric layer formed on the adhesion surface of the conveying means, and as a result, an equal amount of charge of opposite polarities are created in other portions of the dielectric layer. This charge is attracted by the charge of the dielectric layer, and thus moves so that it collects in the electrode parts. Accordingly, the dielectric layer and the electrode parts are oppositely charged so that an electric field is created between them. Since the gap between the dielectric layer and electrode parts is much smaller than the gap in the conventional separate-process system, the strength of the electric field is as strong as in the conventional transfer belt system. Accordingly, the field strength is less affected by the dielectric constant of the dielectric layer which varies in accordance with the temperature, humidity, and the time elapsed following opening of the paper package. As a result, the electric field that is generated on the adhesion surface of the conveying means is both sufficiently strong and stable.

When the dielectric sheet is placed on the adhesion surface of the conveying means, an electric charge is created by the electric field on the surface of the sheet that faces the adhesion surface of the conveying means, and since the charge on the adhesion surface of the conveying means and the charge created on the sheet are of opposite polarities, an attractive force is generated between the two charges. As a result, the dielectric sheet is caused to adhere to the adhesion surface of the conveying means and conveyed by the conveying means.

BRIEF DESCRIPTION OF THE DRAWINGS

FIG. 5(*b*) is a side view thereof;

DETAILED DESCRIPTION OF THE INVENTION

Below an apparatus for conveying dielectric sheets of this invention will be described in detail with reference to the accompanying drawings.

Figure 1:
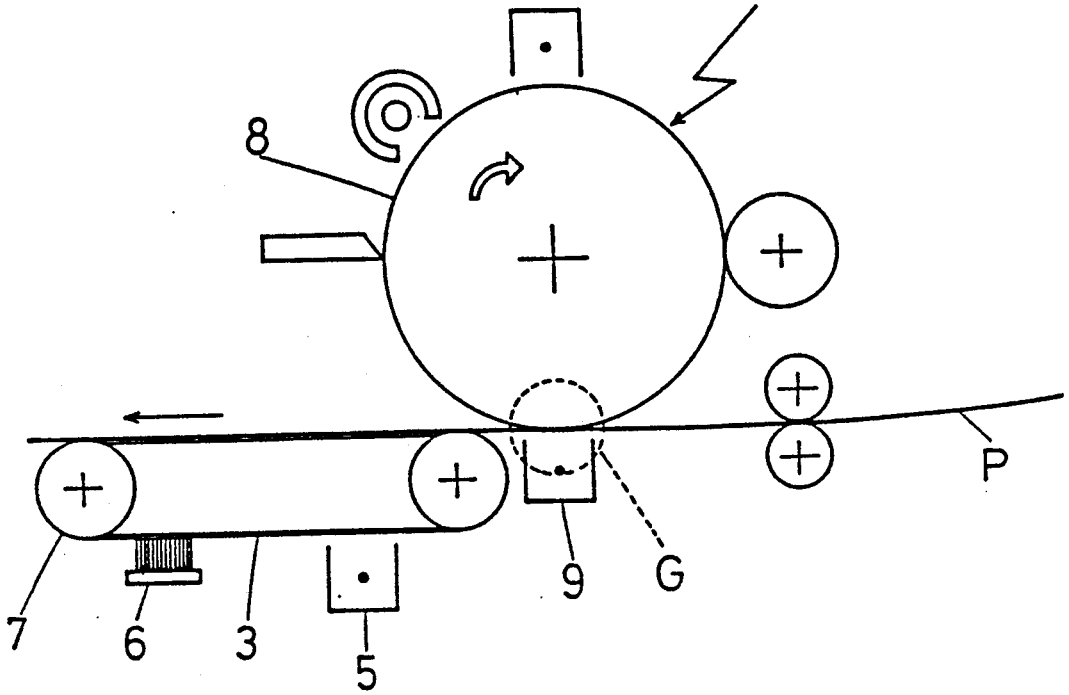
FIG. 1 is a side view of a first embodiment of an apparatus for conveying dielectric sheets according to the present invention.
Figure 2:
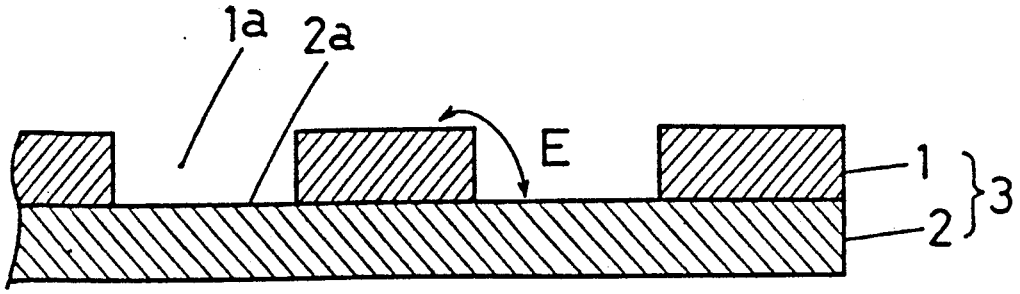
FIG. 2 is a cross-section of a conveyor belt used in the embodiment of FIG. 1.

FIG. 1 is a side view of the essential section of a first embodiment of the present invention in which the apparatus is used in an electronic photographic device. FIG. 2 is a cross-section of the conveyor belt of FIG. 1.

In FIG. 2, reference numeral 1 is a charge-carrying part which consists of a dielectric material, 2 is a substrate part which consists of a conductive material and 3 is a conveyor belt (conveying means) which consists of the charge-carrying part 1 and substrate part 2. The mechanical strength of the conveying belt 3 lies in the substrate 2 and the substrate 2 is grounded by means of a metal roller. The portions of the surface of the substrate part 2 consisting of a conductive material located adjacent to the charge-carrying parts 1 constitute electrode parts 2*a*. In FIG. 1, P indicates paper constituting sheets to be conveyed, 5 indicates a belt charger, 6 indicates a charge-removing brush, 7 indicates a driving roller, 8 indicates a photosensitive part and 9 indicates a transfer charger.

When the driving roller 7 is caused to rotate by a driving motor (not shown), the conveyor belt 3 moves around the two rollers on which it is mounted. By the belt charger 5, a positive charge is imparted to the surface of the conveyor belt 3 by a corona discharge. As a result of this corona discharge, a positive charge accumulates on the surfaces of the charge-carrying parts 1 consisting of a dielectric material, and a negative charge is created on the undersurfaces of the charge-carrying parts 1. This undersurface negative charge is conducted to the electrode parts 2*a* of the conductive substrate part 2, so that the surfaces of the electrode parts 2*a* are charged to a negative potential. As a result, local electric fields E are generated near the boundaries between the charge-carrying parts 1 and the electrode parts 2*a*.

When the paper P is sent from the preceding transfer area G onto the conveyor belt 3 on the surface where local electric fields have been generated as described above, the undersurface of the paper P is polarized by the local electric fields E. As a result, a negative charge is created in the areas facing the charge-carrying parts 1 and a positive charge is created in the areas facing the electrode parts 2*a*. Accordingly, the paper P is caused to adhere to the conveyor belt 3 by electrostatic adhesion. Since the conveyor belt 3 is driven by the driving roller 7, the paper P is conveyed by the conveyor belt 3. Then, when the paper P reaches the driving roller 7, the conveyor belt 3 bends downward around the circumference of the driving roller 7. However, the paper P, because of its rigidity, does not bend along with the conveyor belt 3 and thus, the paper P peels away from the conveyor belt 3 and is sent to the subsequent fixing process (not shown).

Since the gaps between the charge-carrying parts 1 and electrode parts 2*a* are extremely small compared to the gaps between conventional electrodes, a sufficiently strong and stable electric field strength can be obtained, and this field strength is not easily susceptible to the effects of temperature, humidity or the time elapsed following the opening of the paper package.

Furthermore, the following merit is obtained, i.e. since electric fields are applied only to the undersurface of the paper P, there is no disturbance of the unfixed image formed on the top surface of the paper by electronic photography. Accordingly, a sharp image can be obtained.

The charge-carrying parts 1 may be formed by pasting dielectric sheets consisting of a dielectric polymer material such as PET, polyvinyl chloride, nylon, polyolefin, etc. to the substrate at prescribed intervals, or by applying a dielectric paint formed by dissolving a dielectric polymer material in an organic solvent and applying such to the substrates at prescribed intervals. The charge-carrying parts 1 may also be formed as a dielectric layer which has a multiple number of openings 1*a* formed in it. The conductive substrate part 2 can be formed by mixing a conductive powder or conductive fibers such as powdered carbon, a powdered metal, fine metal wires, etc. with a flexible sheet-form polymer substrate such as rubber, PET, polyvinyl chloride, etc.

A resistance of $1\times10^8$ ohm.cm or less may be used to ground the substrate 2.

It is advisable to set the width of the charge-carrying parts 1 at 3 mm, the thickness at 0.1 mm or less and the width of the electrode parts 2*a* at 1 mm or less. Furthermore, the resistance of the conductive material constituting the conductive substrate part 2 should be $1\times10^8$ ohm.cm or less and preferably $1\times10^6$ ohm.cm or less.

The charging process performed in the belt charger 5 is not limited to corona discharge. Charging methods utilizing a radiation source, static charge creation or a conductive rubber roll, etc. may also be used. Furthermore, the surfaces of the charge-carrying parts 1 may be either positively or negatively charged; even in cases where the apparatus of the present invention is used in electronic photography, this polarity may be selected as desired regardless of the polarity used for the transfer process.

Figure 3:
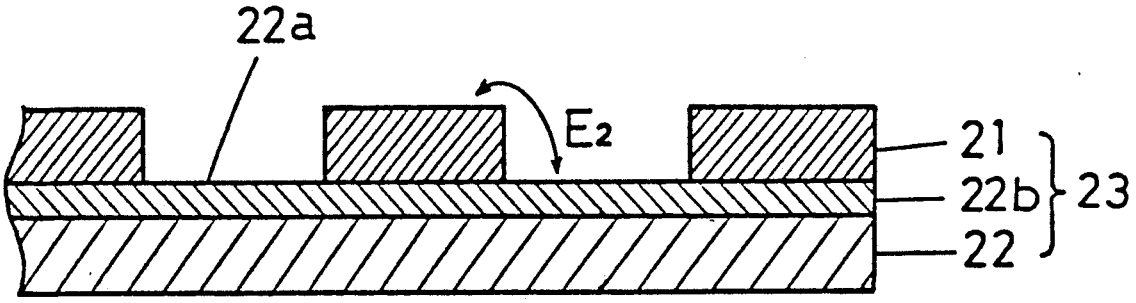
FIG. 3 is a cross-section of a conveyor belt of a second embodiment of the present invention.

FIG. 3 is a cross section of the conveyor belt of a second embodiment of the present invention. In FIG. 3, 21 indicates charge-carrying parts consisting of a dielectric material, 22 indicates a flexible substrate part, 22*b* indicates a conductive layer formed on the surface of the substrate part 22 and 22*a* indicates electrode parts. The conveyor belt 23 consists of the charge-carrying parts 21, conductive layer 22*b*, electrode parts 22*a* and substrate part 22. The mechanical strength of this conveyor belt 23 lies in the substrate part 22. The portions of the surface of the conductive layer 22*b* that are located adjacent to the charge-carrying parts 21 constitute the electrode parts 22*a*.

In this embodiment, as in the first embodiment, local electric fields $E_2$ are generated between the charge-carrying parts 21 and the electrode parts 22*a* when a charge is caused to accumulate on the surface of the charge-carrying parts 21 by means of corona discharge, etc. As a result of these local electric fields $E_2$, the paper P is held on the conveyor belt by electrostatic adhesion and is thus conveyed by the conveyor belt 23.

Figure 4:
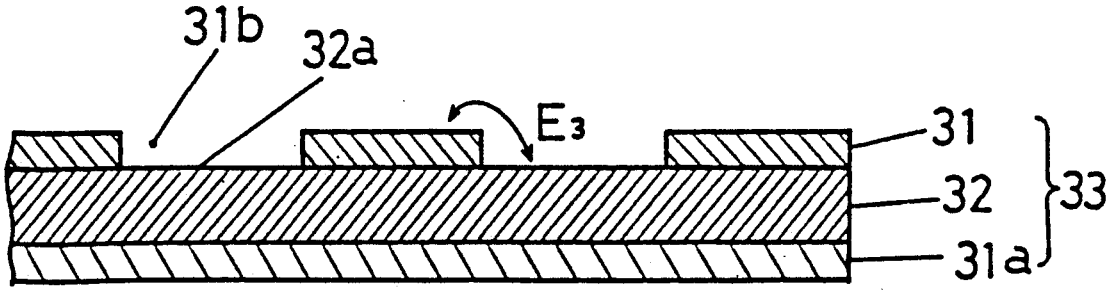
FIG. 4 is a cross-section of a conveyor belt of a third embodiment of the present invention.

FIG. 4 is a cross section of the conveyor belt of a third embodiment of the present invention. In FIG. 4, reference numeral 32 is a dielectric layer which has both flexibility and mechanical strength. Reference numeral 31 is a conductive layer formed in a band shape and provided at prescribed intervals on the upper surface of the dielectric layer 32. Charge-carrying parts 32*a* are formed in areas adjacent to the conductive layer 31. Another conductive layer 31*a* is formed across the entire undersurface of the dielectric layer 32. Thus, the conveyor belt 33 consists of the dielectric layer 32, charge-carrying parts 32*a*, conductive layers 31 and 31*a*. Instead of forming the conductive layer 31 in band shape as described above, it is also possible to form openings 31*b* in the conductive layer 31 to obtain the same effect as with the band shaped conductive layer.

In this embodiment, as in the previously described embodiment, local electric fields $E_3$ are generated between the charge-carrying parts 32*a* and the electrode parts 31 when a charge is caused to accumulate on the surface of the charge-carrying parts 32*a* by means of corona discharge, etc. As a result of these local electric fields $E_3$, the paper P is held on the conveyor belt by electrostatic adhesion and is thus conveyed by the conveyor belt 33.

Figure 5:
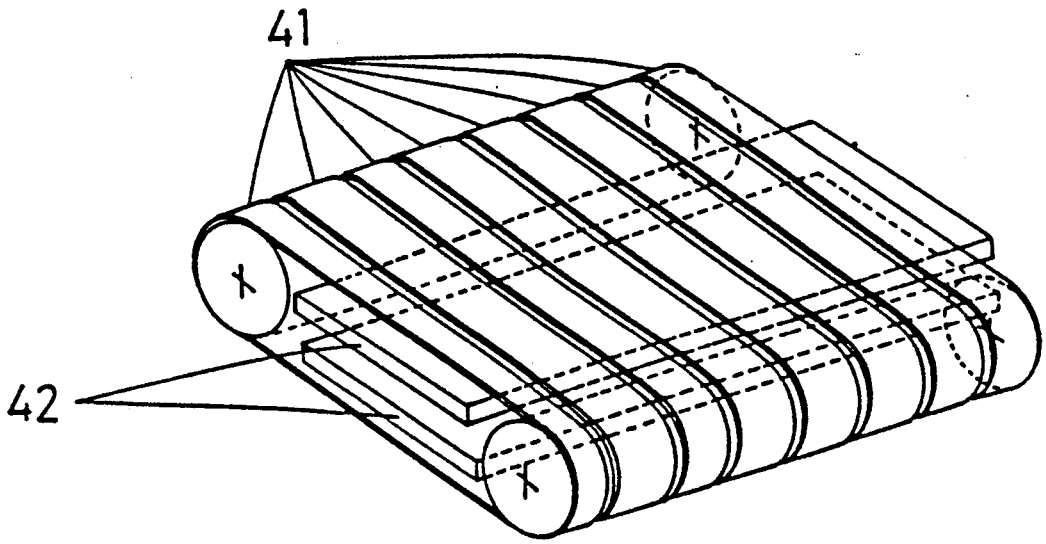
FIG. 5(*a*) is a perspective view of a fourth embodiment of the present invention.
Figure 5:
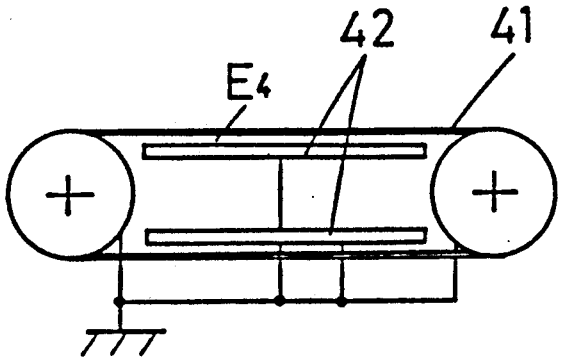

FIG. 5(*a*) is a perspective view of a fourth embodiment of the present invention and FIG. 5(*b*) is a side view thereof. In FIGS. 5(*a*) and 5(*b*), a multiple number of flexible oblong dielectric belts 41 are mounted on grounded metal rollers with grounded metal plates 42 therein. In this case, the surfaces of the flexible dielectric belts 41 act as charge-carrying parts and the portions of the metal plates 42 adjacent to the flexible dielectric belts 41 form electrode parts.

Figure 6:
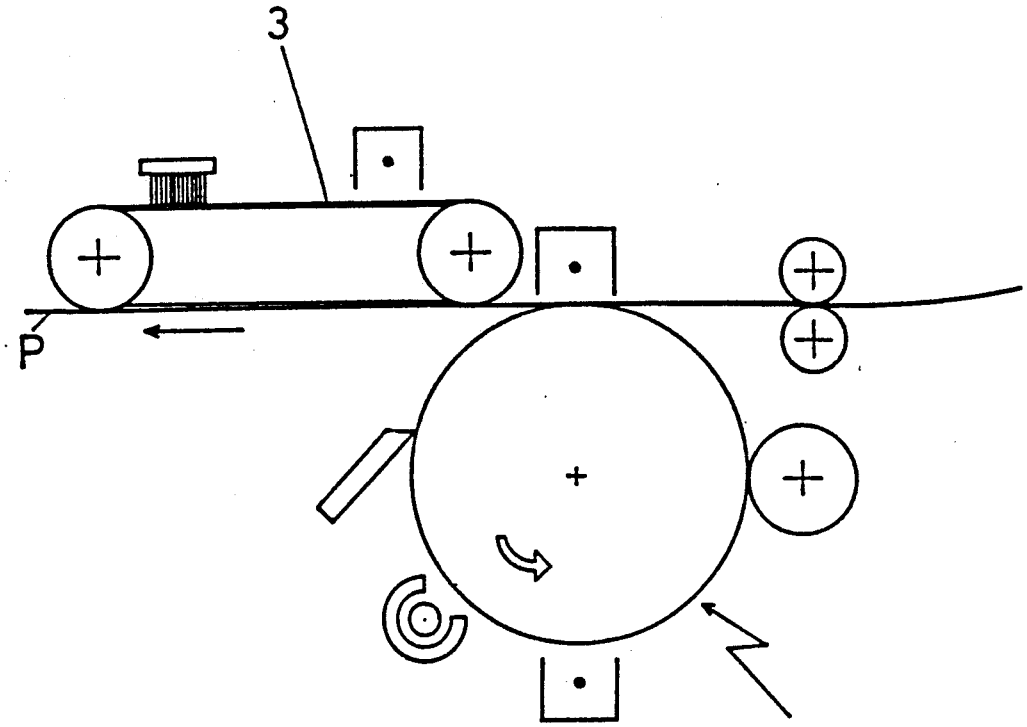
FIGS. 6, 7 and 8 are explanatory diagrams which illustrate examples of the application of the present invention.

In this embodiment, as in the previously described embodiment, local electric fields $E_4$ are generated between the flexible dielectric belts 41 and the metal plates 42 when a charge is caused to accumulate on the surfaces of the flexible dielectric belts 41 by means of corona discharge, etc. Furthermore, if the conveyor of the present invention is constructed so that the surface on which the local electric fields E are formed is positioned on the bottom of the conveyor belt 3 (as shown in FIG. 6), the sheets of paper P with printing on their lower surfaces can be held by electrostatic adhesion via their upper surfaces, and can be conveyed in this attitude. With this arrangement, printed matter consisting of a multiple number of printed pages can be printed so that the first page printed will come at the front of the stack when the pages are extracted from the apparatus.

Figure 7:
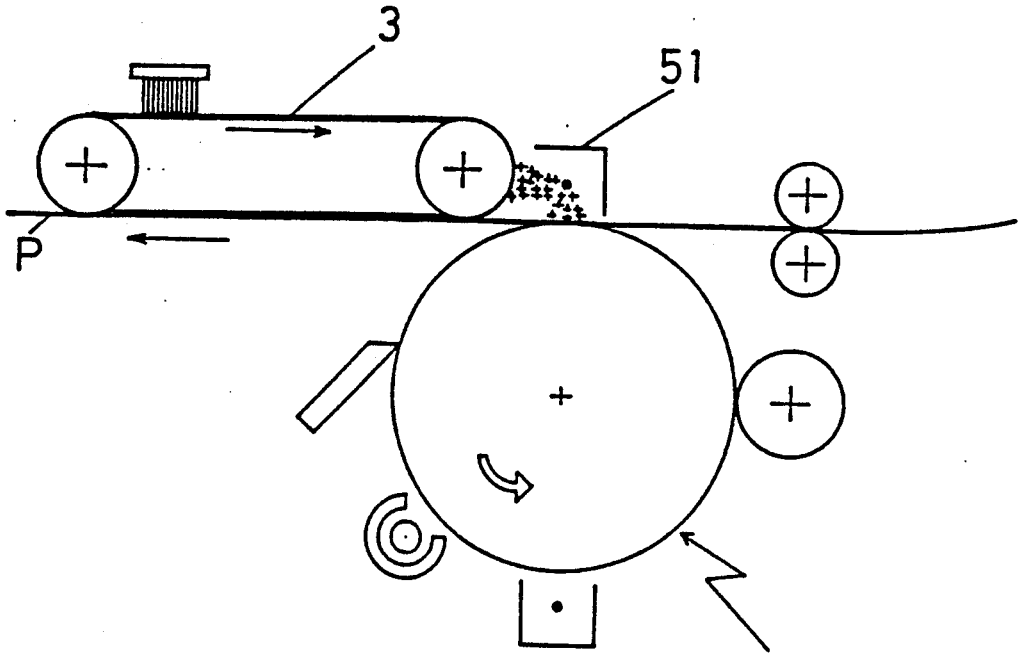

It would also be possible to combine the charger required in the transfer area and the charger required for the conveyor belt into a single transfer/conveyor charger 51 as shown in FIG. 7.

Figure 8:
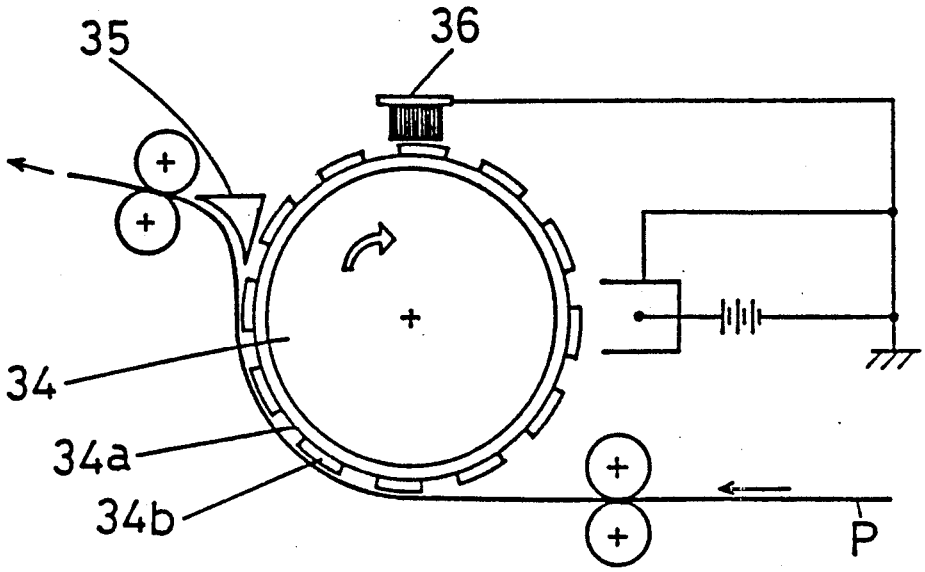
Figure 9:
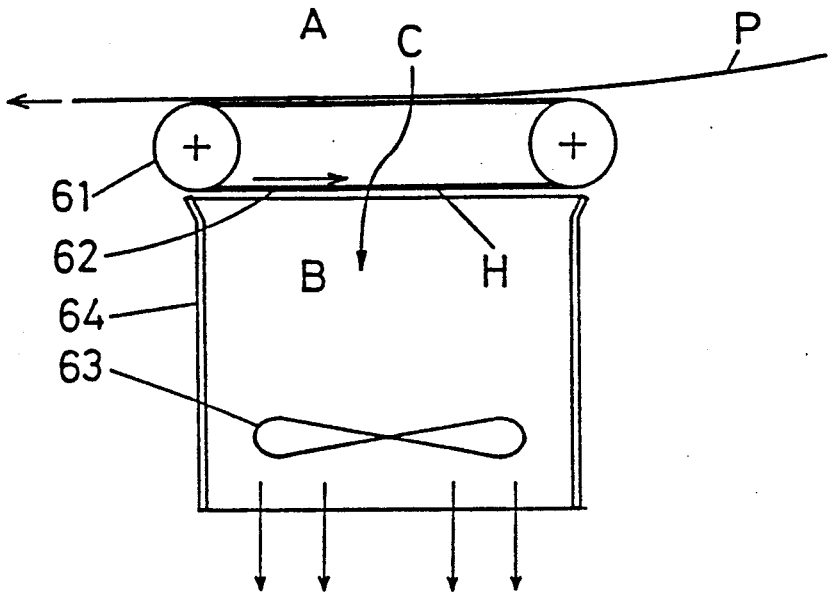
Figure 9 Prior Art
FIGS. 9, 10, 11 and 12 are explanatory diagrams which illustrate conventional Prior Art conveyors.
Figure 10:
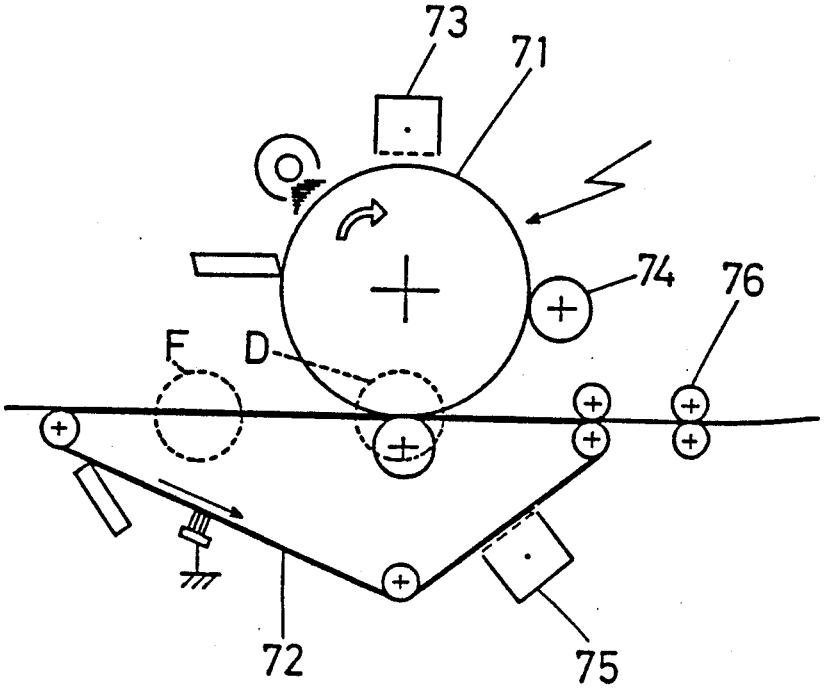
Figure 10 Prior Art
Figure 11:
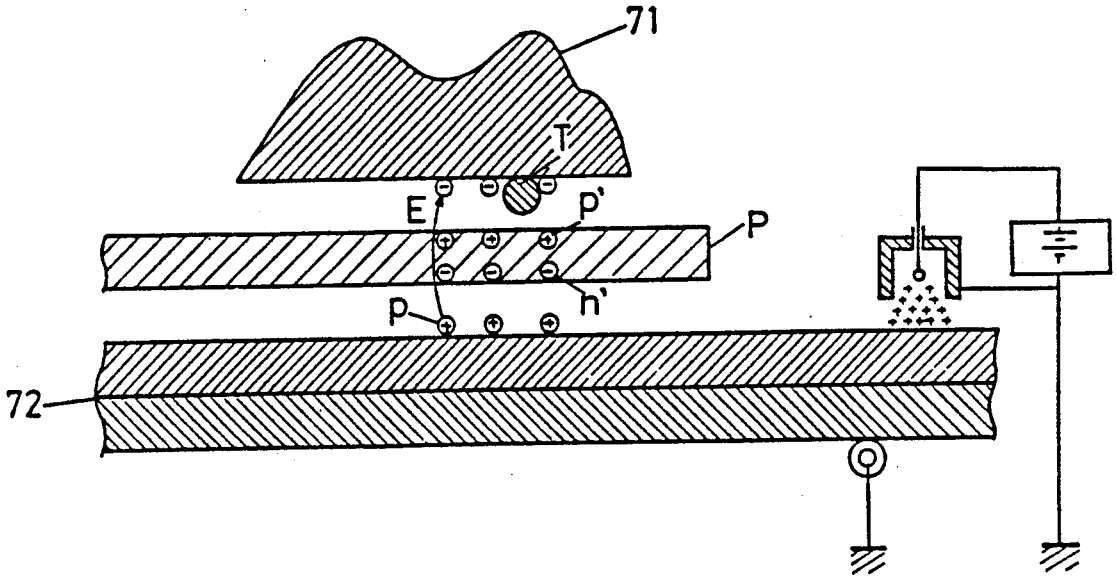
Figure 11 Prior Art
Figure 12:
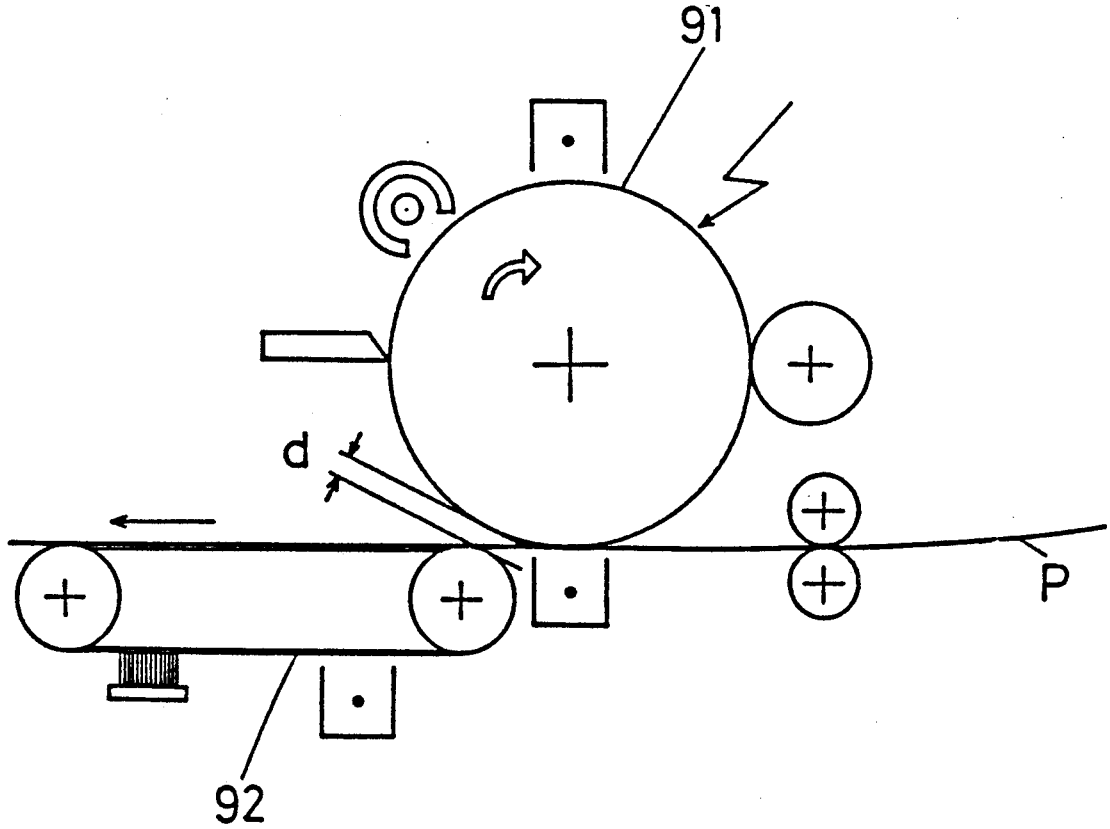
Figure 12 Prior Art

In addition, it is possible to install a multiple number of charge-carrying parts 34*b* consisting of a dielectric material and a multiple number of electrodes parts 34*a* consisting of conductive material in an alternating pattern on the surface of a conveyor drum 34 as shown in FIG. 8. In this case, local electric fields E are generated along the circumferential surface of the conveyor drum 34; thus, the paper P is bent around the circumference surface of the conveyor drum 34 when it is conveyed. In this case, it would be advantageous to install separating claws 35 in a desired position in order to facilitate separation of the paper P from the drum 34.

When the conveyor drum 34 is used, it is possible to set the feed-out direction of the paper P at any desired angle relative to the feed-in direction. Furthermore, it is possible to install a charge-removing means such as a charge-removing brush 36, etc. in order to insure a stable charge state. Moreover, a cleaning means such as a blade, etc. may also be installed in order to remove contaminants from the surface of the conveying part.

In all of the above described embodiments either a positive or negative charge may be caused to accumulate on the surfaces of the charge-carrying parts; thus, it is merely necessary that local electric fields be formed near the boundaries between the charge-carrying pats and the electrode parts.

The conveyor for dielectric sheets of the present invention can be used in a variety of devices which convey dielectric sheet materials and such materials are not limited to paper, but may also include Mylar sheets, etc.

The conveyor of the present invention can be used in a sheet conveying mechanism provided inside printing devices such as copying machines and printers or as a conveying mechanism in automatic original sheet feed devices used in such copying machines.

In all cases, the sheets that are to be conveyed are held and conveyed by electrostatic adhesion which acts only on one side of the sheets. Accordingly, stable conveying action can be achieved which is unaffected by changes in temperature, humidity or the condition of the sheets. Furthermore, when the present invention is used in electronic photography an air stream which blows the toner about is not generated. Accordingly, soiling of the apparatus and the conveyed sheets can be prevented. In addition, since the electric fields are not generated so as to disturb unfixed toner, there is no disturbance of the photographic images, and as a result, sharp images can be obtained.

As described in detail above, according to the present invention, dielectric sheets are held by electrostatic adhesion and conveyed by charging a dielectric layer and electrode parts formed on the adhesion surface of a conveying means to opposite polarities, so that electric fields are generated between the dielectric layer and electrode parts. Since the gap between the charge-carrying parts and the electrode parts is considerably smaller than the gap in conventional separate-process systems, the strength of the electric field in the present invention is as strong as that in a conventional transfer belt system. Accordingly, the electrostatic adhesion force of the adhesion surface of the conveying means in the present invention tends not to be affected by the dielectric constant of the sheets being conveyed which varies with temperature, humidity and the time elapsed following the opening of the paper package. Accordingly, a sufficiently strong and stable conveying force can be obtained using the conveyor for dielectric sheets provided by the present invention.

We claim:

1. An apparatus for conveying dielectric sheets in which said sheets to be conveyed consist of a dielectric material which are held by electrostatic adhesion on an adhesion surface of a conveying means of said apparatus when said adhesion surface is charged by a charging means and conveyed by causing said conveying means to move, said apparatus being characterized in that said adhesion surface consists of a dielectric material and electrode parts which consist of a conductive material provided adjacent to each other on said adhesion surface of said conveying means and said dielectric material and said electrode parts are both electrostatically charged by said charging means to different polarities whereby a strong and stable electrostatic field is created between said dielectric material and said electrode parts of said conveying means for electrostatically adhering said dielectric sheets to said conveying means.

2. An apparatus according to claim 1 characterized in that said dielectric material is formed on the adhesion surface of said conveying means, and a multiple number of band shaped layers of said conductive material are formed on an upper surface of said dielectric layer.

3. An apparatus according to claim 1 characterized in that said dielectric material having a multiple number of openings formed therein is formed on the adhesion surface of said conveying means, and said conductive material is formed on the under surface of said dielectric layer.

4. An apparatus according to claim 1 characterized in that said conductive material is formed on the adhesion surface of said conveying means, and a multiple number of parts of said dielectric material are formed on the upper surface of said conductive material.

5. An apparatus according to claim 1 characterized in that said conductive material having a multiple number of openings formed therein is formed on the adhesion surface of said conveying means, and said dielectric layer is formed on the under surface of said conductive material.

6. An apparatus according to any one of claims 1 through 5 characterized in that said conveying means is a flexible belt.

7. An apparatus according to any one of claims 1 through 5 characterized in that said conveying means is a cylindrical drum.

* * * * *